United States Patent [19]

Dauenbaugh

[11] 4,012,928

[45] Mar. 22, 1977

[54] CYLINDER RETENTION MECHANISM

[75] Inventor: Robert L. Dauenbaugh, Rockford, Ill.

[73] Assignee: Keystone Consolidated Industries, Peoria, Ill.

[22] Filed: Feb. 27, 1976

[21] Appl. No.: 662,153

[52] U.S. Cl. ..... 70/81; 70/134; 70/156; 70/DIG. 62; 292/147

[51] Int. Cl.[2] ..... E05B 65/44; E05B 9/06

[58] Field of Search ..... 70/81, 85, 86, 134, 70/156, 371, DIG. 62; 248/27; 292/147; 85/8.8

[56] References Cited

UNITED STATES PATENTS

| | | | |
|---|---|---|---|
| 1,979,938 | 11/1934 | Jacobi | 70/DIG. 62 |
| 3,526,111 | 9/1970 | Jacobi | 70/371 X |
| 3,589,152 | 6/1971 | Glass | 70/81 |
| 3,824,817 | 7/1974 | Orr | 70/81 |

FOREIGN PATENTS OR APPLICATIONS

| | | | |
|---|---|---|---|
| 879,217 | 4/1953 | Germany | 70/370 |

*Primary Examiner*—J. Franklin Foss
*Attorney, Agent, or Firm*—Allegretti, Newitt, Witcoff & McAndrews

[57] ABSTRACT

A lock device includes a housing and a removable cylinder normally retained in the housing by a rotatable retainer ring. The retainer ring is driven by a shifter and cylinder change key between a locked and unlocked position. The retainer ring is normally biased to the locked position so that tabs associated with the retainer ring will engage appropriate locking channels of the cylinder and retain the cylinder in fixed position in an opening of the housing.

10 Claims, 16 Drawing Figures

Fig. 3
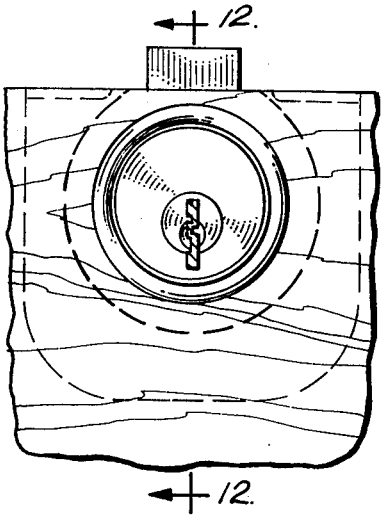
Fig. 4
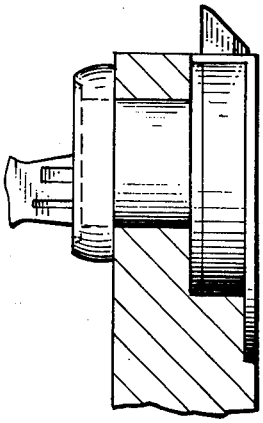
Fig. 5
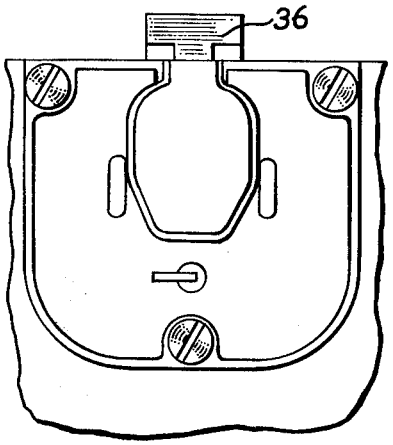
Fig. 6
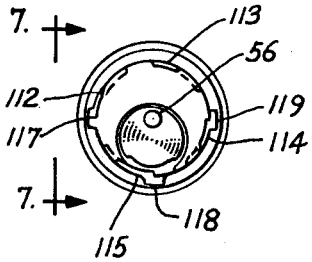
Fig. 7
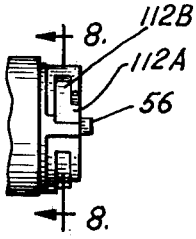
Fig. 8
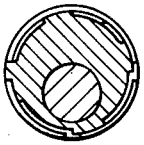
Fig. 9
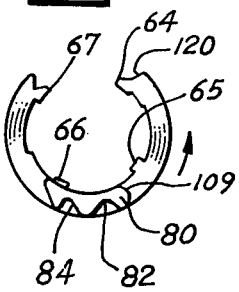
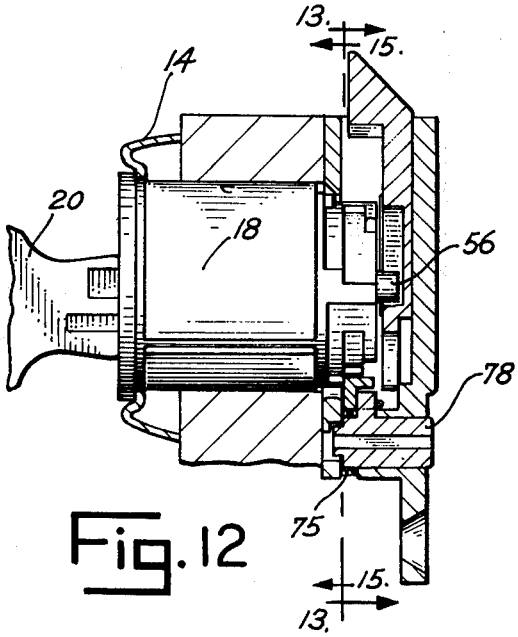
Fig. 12
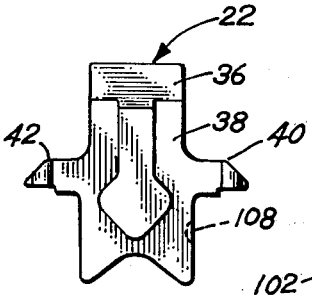
Fig. 10
Fig. 11
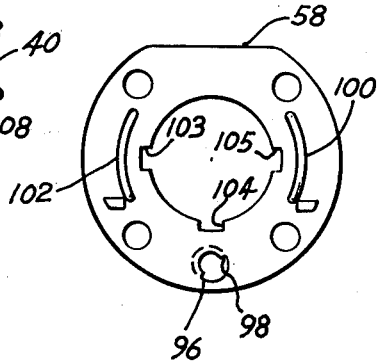

CYLINDER RETENTION MECHANISM

BACKGROUND OF THE INVENTION

The present invention relates to an improved locking device comprised of a housing assembly and a separable cylinder assembly.

In U.S. Pat. No. 3,824,817 issued July 23, 1974, a removable cylinder lock especially useful in combination with furniture, office, business equipment or the like was disclosed. The removable cylinder lock included a housing with a bolt. The housing and bolt would normally be installed in the furniture, office business equipment or the like as part of the furniture. A cylinder would then be attached to the housing by a locking spring in the housing. Consequently, the tumbler mechanism of the cylinder would not be exposed to the furniture finishing process. Lock hardware would be added following final assembly of the furniture or could be changed if failure occurred or the key combination required change.

The separation of the housing and bolt into a separate sub-assembly from the key locking assembly is a valuable benefit to the original equipment manufacturer. It relieves him of all record keeping and responsibility for keying and key changes of the locks that are subsequently installed in his product (drawers, doors, furniture etc.) in the field by the lock user. The manufacturer need only install the housing and bolt sub-assembly. The locks are installed by the user of the furniture. This has also been an aid to the lock user, in the case of banks, wherein the locks, keyed differently, can be easily changed from place to place with the use of the change key.

U.S. Pat. No. 3,824,817 discloses a removable lock cylinder which relies upon utilization of a bifurcated spring that grips and retains the cylinder in the housing. To disengage the cylinder, the bifurcated spring is flexed by a tool insertable from the back of the housing. While such a structure worked in an adequate and sufficient manner, manufacture of the bifurcated spring to obtain consistent spring quality has proven to be overly expensive. Thus, an improved control mechanism for locking and retaining the cylinder assembly in the housing assembly is desirable.

SUMMARY OF THE INVENTION

In a principal aspect, the present invention comprises improved means for retaining a lock cylinder removably connected in a housing of the type having a movable bolt positioned therein. The retaining mechanism includes a retaining ring circumferentially positioned about the opening in the housing assembly for receipt of the lock cylinder. The retaining ring cooperatively engages the lock cylinder and may be rotated to disengage the lock cylinder permitting removal thereof from the housing to install a lock with a different combination or for replacement or repair.

Thus, it is an object of the invention to provide an improved retaining mechanism for a lock cylinder in a housing.

It is a further object of the present invention to provide improved means for retaining a lock cylinder which means include a crescent shaped retainer ring which is rotatable about an opening for the cylinder in a bolt housing between a locked and unlocked position.

Still a further object of the present invention is to provide a means for retaining a lock cylinder which means is responsive to a key type actuator.

A further object of the present invention is to provide an improved cylinder retention mechanism which includes means for continuously and positively biasing a retention member into engagement with a lock cylinder.

One further object of the present invention is to provide a lock cylinder assembly of simple and economic construction.

These and other objects, advantages and features of the invention will be set forth in the detailed description which follows.

BRIEF DESCRIPTION OF THE DRAWING

In the detailed description which follows, reference will be made to the drawing comprised of the following figures:

FIG. 3 is a front plan view of the assembly;

FIG. 4 is a side elevation of the assembly shown in FIG. 3;

FIG. 5 is a rear elevation of the assembly shown in FIG. 3;

FIG. 6 is a rear end view of the cylinder of the lock assembly;

FIG. 7 is a partial side elevation of the lock cylinder taken along the line 7—7 in FIG. 6;

FIG. 8 is a cross-sectional view of the lock cylinder taken along the line 8—8 in FIG. 7;

FIG. 9 is an elevation of the retainer ring incorporated as part of the bolt housing of the lock assembly;

FIG. 10 is an elevation of the spring bolt used in the bolt housing of FIG. 2;

FIG. 11 is an elevation of the retainer opening plate of the bolt housing;

FIG. 12 is a cross-sectional view of the assembly taken along the line 12—12 in FIG. 3;

DESCRIPTION OF THE PREFERRED EMBODIMENT

Figure 1:
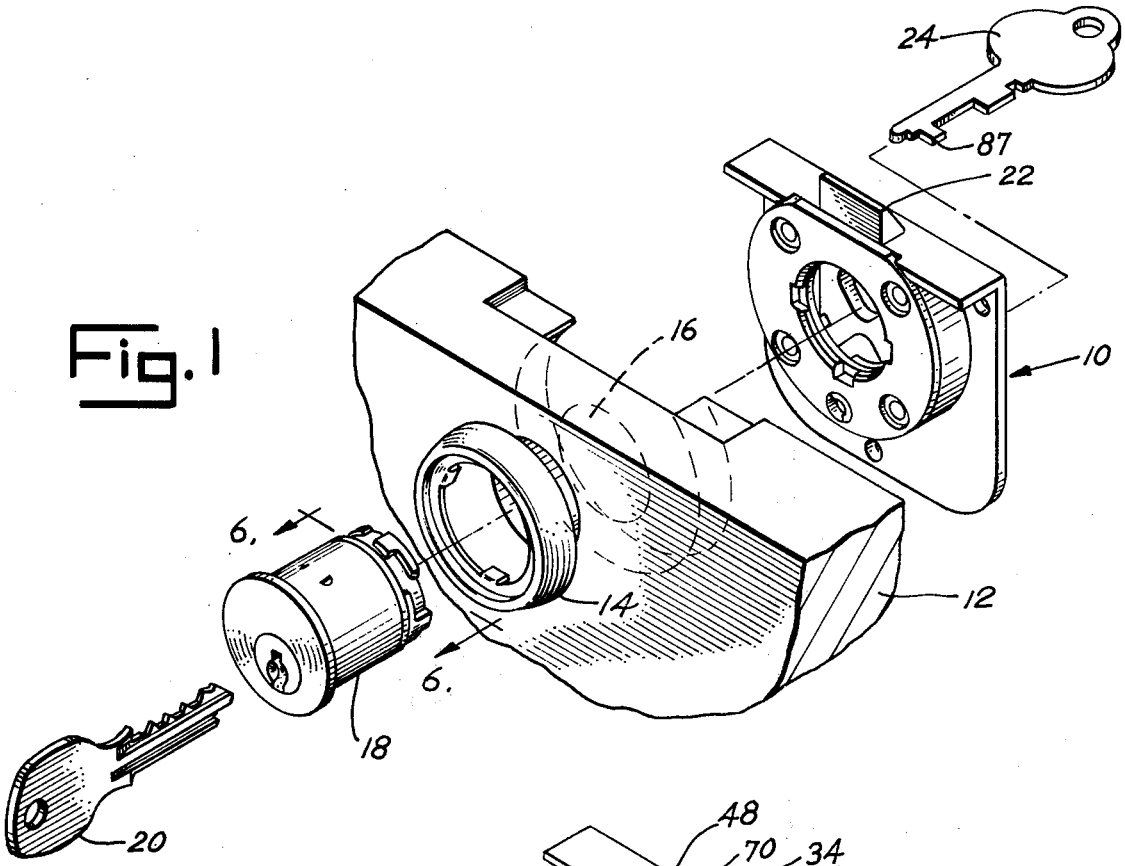
FIG. 1 is an exploded perspective view of the lock assembly of the present invention.

Referring to FIG. 1, the lock assembly of the present invention includes a bolt housing 10 which is mortised in a panel 12 and retained therein by appropriate fastening means such as screws, bolts and the like. A cylinder escutcheon 14 cooperates with a cylindrical opening 16 through panel 12. A cylinder 18 fits through escutcheon 14 and opening 16 and cooperatively engages housing 10 as will be described in more detail below. FIGS. 3–5 illustrate the assembled configuration of the cylinder 18 and housing 10. A key 20 is provided to operate the tumbler mechanism associated with the cylinder 18, thereby actuating a bolt 22 associated with the housing 10. A cylinder release key 24 cooperates with a retainer mechanism maintained within housing 10 to effect release of the cylinder 18 from cooperative engagement with the housing 10.

In normal operation, the housing 10 is mortised and attached to the panel 12. Note that this description relates to utilization of the lock assembly of the invention in a wood panel. The assembly may also be used with metal furniture or furniture of other materials. The complete lock assembly is easily applied to all metal office furniture as well. The cylinder 18 and bolt housing 10 may be added after all finishing operations are complete. In the event it is necessary to change the cylinder 18 for any reason, operation of the release key 24 will permit removal and replacement of the cylinder 18 for fast combination change purposes. The specific structure for the retention and/or release of the cylinder 18 from housing 10 constitutes, in the combination shown, the subject matter of the present invention.

Figure 2:
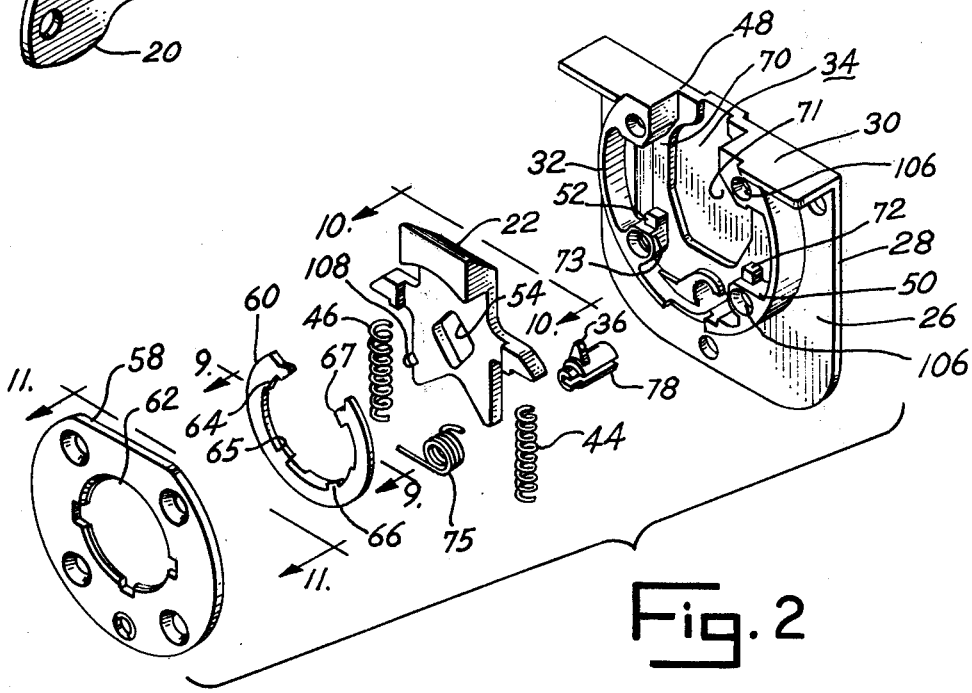
FIG. 2 is an exploded perspective view of the bolt housing for the lock assembly.

Referring next to FIG. 2 and various associated figures, the housing 10 includes a box 26. Box 26 includes a back panel 28 and a top panel 30. A side wall 32 defines a cavity 34 on the inside of the back panel 28 for receipt of bolt 22. The specific configuration of spring bolt 22 is illustrated in FIG. 10.

Bolt 22 includes a strike engaging projection 36 connected with a main body portion 38. Laterally projecting arms 40 and 42 cooperate with coil springs 44 and 46 in the manner illustrated in FIGS. 13 and 14 to normally project the bolt 22 outward through an opening 48 defined in top panel 30 of box 26. The bolt 22 has a normally projected position as a result of the biasing force imparted by springs 44 and 46. The springs 44 and 46 are positioned between arms 40 and 42 and ledges 50 and 52 respectively in cavity 34.

A bolt actuating channel 54 is defined within the body portion 38. Channel 54 cooperates with a bolt actuating member 56 extending from the cylinder 18. Actuating member 56 is shown in FIGS. 6, 7 and 12.

Positioned within the cavity 34 intermediate bolt 22 and a cover 58 is a retainer ring 60. The retainer ring 60 is a crescent shaped or arcuate member having an inside opening substantially as large as an opening 62 in cover 58. Opening 62 is for receipt of the end of cylinder 18. The opening 62 in cover 58 is circular except for spaced slots 103–105. Cover 58 also includes arcuate walls 100 and 102 as shown in FIG. 11 which cooperate with the outside edge of retainer ring 60 to further maintain proper orientation of the ring 60 within the housing 10. Cover 58 is staked with four studs 106 projecting from panel 28 through four counter sunk holes in cover 58, thereby maintaining the housing 10 as a single assembly.

Retainer ring 60 includes four radially inward projecting tabs 64–67. The outer surface of ring 60 is generally cylindrical and cooperates with retainer ring retention surfaces 70–73 defined by side wall 32. In this manner, the ring 60 is maintained in a plane substantially perpendicular to the axis of the opening 62 with the center of the ring 60 being substantially coincident with the center of the opening 62.

A tension spring 75 fits over a shifter 78 as shown in FIG. 12. One end of the spring 75 engages wall 32 while the other end of the spring 75 is engaged over shifter 78. The shifter 78 is retained between cover 58 and panel 28. Shifter 78 cooperates with retainer ring 60 and normally is biased by spring 75 to maintain ring 60 in the position illustrated in FIGS. 13 and 15. This is discussed in greater detail below.

FIG. 9 illustrates the side of the retainer ring 60 opposite that illustrated in FIG. 2. Thus, the tabs 64–67 are illustrated. Additionally, a shifter cooperating cam 80 is depicted. Cam 80 includes a first indentation 82 and a second indentation 84. The retainer ring 60 may be rotated about its center axis in response to simultaneous manual movement of shifter 78 and key 24.

Figure 13:
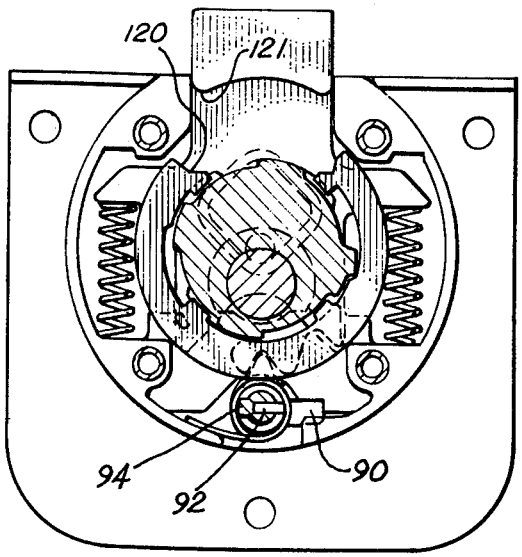
FIG. 13 is a cross-sectional view of the lock assembly taken along the line 13—13 in FIG. 12.
Figure 14:
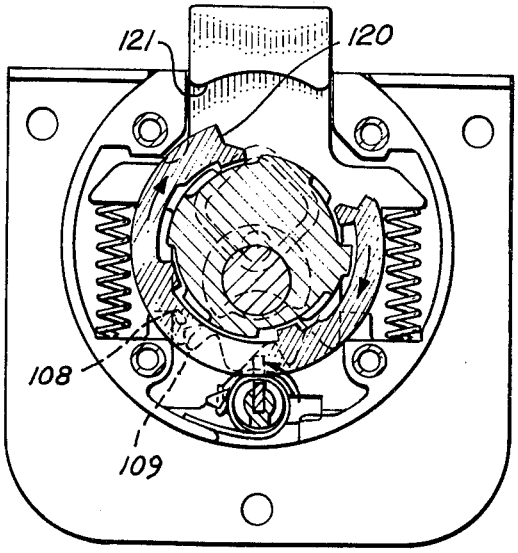
FIG. 14 is a cross-sectional view similar to FIG. 13 wherein the retainer ring has been transferred to the lock cylinder release position.
Figure 16:
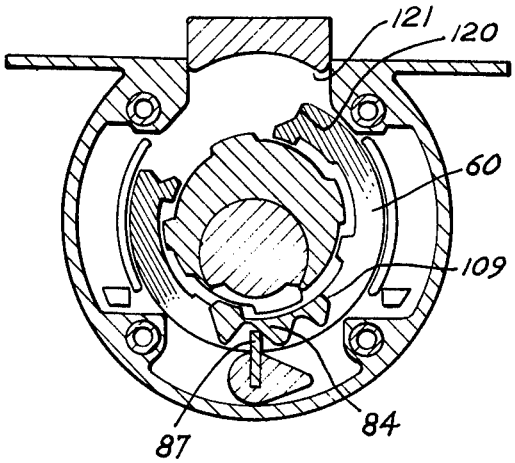
FIG. 16 is a cross-sectional view similar to FIG. 15 wherein the retainer ring has been moved to the unlocked position illustrated by FIG. 14.

Note that key 24 fits through a slotted opening 90 in the housing 10 and cooperates with slot 92 in shifter 78. Shifter 78 includes an active cam shifter 86 which cooperates with the first indentation 82 as illustrated in FIG. 13. Manual operation of shifter 78 against biasing force of spring 75 drives the retainer ring 60 in the direction indicated by the arrow in FIGS. 14 and 16. Following initial driving or rotation of the retainer ring 60 in response to actuation by the active cam surface 86, the surface 86 disengages from indentation 82 and a lobe 87 of key 24 engages the second indentation 84 to cause further rotation of the retainer ring 60. This is illustrated in FIGS. 14 and 16. The amount of rotation of shifter 78 is limited by cooperation between projecting tab 94 of shifter 78 and stops 96 and 98 of cover 58 as shown in FIG. 11.

Therefore, the bolt 22 must be in the locked position to install the cylinder 18. With the cylinder 18 out, the bolt 22 can accidentally be pushed in. Means are provided to automatically "cock" the retaining ring 69 for reinstallation of a cylinder 18. Such means are provided by a tab 108 on the outside edge of the body portion 38 of bolt 22 to cooperate with a cam surface 109 which is part of cam 80 on retainer ring 60 (see FIG. 9). Also, cam surface 120 on retainer ring 60 cooperates with corner radius 121 on bolt 22 for the same purpose (see FIGS. 13–16). Cam surface 109 and tab 108 start the "cocking" action and corner radius 121 on bolt 22 cooperates with cam surface 120 on retainer ring 60 to complete the cocking action. After "cocking" the retainer ring, the bolt must be manually returned to the locked position (dead bolt only) and the cylinder release key 24 is used to turn the retaining ring 60 to the correct position to reinstall the cylinder 18.

The cylinder 18 retention mechanism is now described. The retainer ring 60 cooperates with channels or slots 112-115 defined at the end of cylinder 18 as shown in FIGS. 5, and 6–8. The cylinder 18 also includes projecting flanges 117-119 which cooperate respectively with slots 103–105 of cover 58. Thus, the inside end of the cylinder 18 may be inserted through the cover 58, alignment being determined by flanges 112–119 and slots 103–105. This places the projection 56 in cooperative relationship with bolt 22 and more particularly channel 54. The cylinder 18 may be inserted through the opening 62 in cover 58 only when the tabs 64–67 of retainer ring 60 have been oriented so that the tabs 64–67 will fit within the leading edge opening associated with channels 112–115. Thus, tabs 64 will fit within slot 113. Tab 65 will fit within slot 114. Tab 66 will fit within slot 115 and tab 67 will fit within slot 112.

Figure 15:
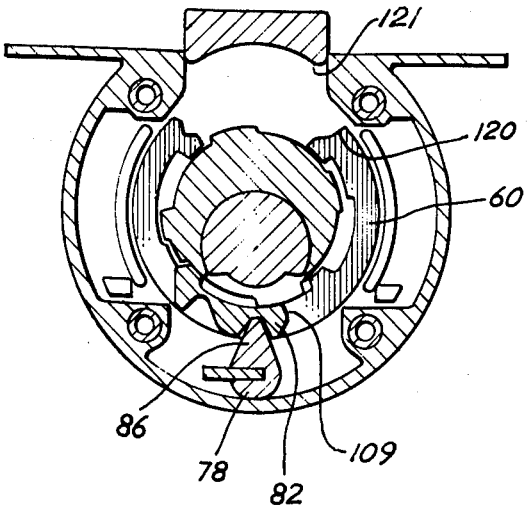
FIG. 15 is a cross-sectional view taken along the line 15—15 in FIG. 12.

Each of the channels 112–115 includes an entry window portion, for example, entry window 112A in FIG. 7 and a channel locking portion 112B in FIG. 7. The ring 60 is rotated to the unlocked position in the manner previously described. Cylinder 18 is then inserted through the opening 58. The tabs 64–67 fit through the entry windows 112A–115A. The release key 24 is then removed permitting ring 60 to rotate so that the tabs 64–67 engage the locking channel portions 112B–115B. When the ring 60 is in the locked position illustrated by FIGS. 13 and 15, the key 24 may be removed. That is, lobe 87 prevents removal of key 24, except when key 24 is oriented as shown in FIGS. 13 and 15. To remove the cylinder 18, the procedure is reversed, i.e., the key 24 in cooperation with the shifter 78 operates to rotate the ring 60 (tabs 64–67 in channels 112–115) to permit withdrawal of the key lock assembly 18.

Thus, the key 24 and shifter 78 operate ring 60 to lock or unlock the cylinder 18. Ring 60 is biased to the locked position by operation of spring 75 which causes shifter 78 to maintain the ring 60 in the locked position. In this manner, a cylinder 18 may be easily removed or replaced in housing 10.

The locking mechanism may be utilized with any cylinder and housing combination. Thus, for example, the housing 10 may include a dead bolt configuration. Therefore, while in the foregoing there has been presented a preferred embodiment of the invention, it is to be understood that the subject matter of the invention shall be limited only by the following claims and their equivalents.

What is claimed is;

1. In a lock device of the type including a housing and a removable cylinder, said housing including a bolt slidable between a projected position and a retracted position, said housing also including an opening for receipt of part of the lock cylinder, said lock cylinder including a member for drivingly engaging the bolt when said lock cylinder is retained with said housing, the improvement of means for retaining the lock cylinder in the housing comprising, in combination:

a retainer ring extending at least partially, circumferentially about the opening;

means including a shifter mounted in the housing engageable with the ring for rotating said ring between a first locked position and a second unlocked position;

one of said cylinder and said ring including at least one projecting tab; and the other of said cylinder and said ring including at least one channel for receipt of said tab whenever said cylinder is in the locked position whereby said ring and said cylinder may be rotated relative to each other to unlock said cylinder from said housing.

2. The improvement of claim 1 wherein said ring is crescent shaped and includes at least one inwardly projecting tab for engaging a channel defined in the cylinder.

3. The improvement of claim 1 wherein said ring and bolt include cooperative projections which engage when said ring is in the unlocked position and said bolt is moved from the projected toward the retracted position, whereby said cylinder cannot be removed unless the bolt is in the projected position.

4. The improvement of claim 1 wherein said means for rotating said ring includes a biasing spring in said housing engaging the shifter in said housing and biasing the shifter against the ring to, in turn, engage and drive the ring toward the locked position.

5. The improvement of claim 1 including stop means for limiting the rotation of said ring.

6. The improvement of claim 1 wherein said means for rotating said ring also includes a removable key member for driving said shifter directly upon insertion therein and rotation of said shifter.

7. The improvement of claim 6 wherein said key member drives said shifter and said ring simultaneously.

8. The improvement of claim 1 including means for aligning said cylinder in the opening of said housing.

9. The improvement of claim 1 wherein said ring is rotated circumferentially about the cylinder, said ring including inwardly projecting tabs cooperative with external surface channels defined in the cylinder, said ring also including circumferential indentations cooperative with the shifter, said shifter including a cam member for drivingly engaging the indentation, said shifter being rotatable to operate the cam member against the indentation and thereby rotate the ring.

10. The improvement of claim 9 including a slot in the shifter for receipt of a key, said key operative to rotate the shifter and thereby the ring, said key also including a lobe for engaging a second indentation in the ring and further directly driving and rotating the ring toward the unlocked position.

* * * * *